US010380962B2

(12) United States Patent
Huang et al.

(10) Patent No.: US 10,380,962 B2
(45) Date of Patent: Aug. 13, 2019

(54) DRIVING CIRCUIT APPLIED TO LCD APPARATUS

(71) Applicant: Raydium Semiconductor Corporation, Hsinchu (TW)

(72) Inventors: E-Ling Huang, Hsinchu (TW); Chih Chuan Huang, Zhubei (TW); Wen-Tsung Lin, Tainan (TW)

(73) Assignee: Raydium Semiconductor Corporation, Hsinchu County (TW)

( * ) Notice: Subject to any disclaimer, the term of this patent is extended or adjusted under 35 U.S.C. 154(b) by 413 days.

(21) Appl. No.: 15/292,205

(22) Filed: Oct. 13, 2016

(65) Prior Publication Data

US 2017/0116944 A1 Apr. 27, 2017

(30) Foreign Application Priority Data

Oct. 23, 2015 (TW) ..... 104134860 A

(51) Int. Cl.
*G09G 3/36* (2006.01)

(52) U.S. Cl.
CPC ... *G09G 3/3677* (2013.01); *G09G 2300/0426* (2013.01); *G09G 2320/0223* (2013.01); *G09G 2320/0233* (2013.01)

(58) Field of Classification Search
CPC combination set(s) only.
See application file for complete search history.

(56) References Cited

U.S. PATENT DOCUMENTS

2013/0082987 A1* 4/2013 Kang ..... G02F 1/13452 345/204

* cited by examiner

*Primary Examiner* — Robin J Mishler

(57) ABSTRACT

A driving circuit applied to a LCD apparatus includes N driver chips, a signal source, a WOA wire, a COF wire. Each driver chip is COF-packaged and correspondingly coupled to L output channels. N and L are positive integers and N≥2. The signal source is coupled to L output channels of the first driver chip. One terminal of WOA wire is coupled to L output channels of the second driver chip. One terminal of the COF wire is coupled between the signal source and a first output channel of the first driver chip and another terminal of the COF wire is coupled to another terminal of WOA wire. The resistance of COF wire is far smaller than a first internal resistance between the first output channel and L-th output channel of first driver chip and the resistance of WOA wire is substantially equal to first internal resistance.

20 Claims, 6 Drawing Sheets

DRIVING CIRCUIT APPLIED TO LCD APPARATUS

BACKGROUND OF THE INVENTION

1. Field of the Invention

This invention relates to a display apparatus, especially to a driving circuit applied to a LCD apparatus.

2. Description of the Prior Art

In general, a liquid crystal display system includes a pixel matrix, two polarizers and a plurality of driver chips. These driver chips are usually packaged by chip on film (COF) technology and coupled to a panel peripheral circuit, so that each row and each column of pixels of the panel can be driven by a driving voltage signal. As shown in FIG. 1, a plurality of gate driver chips IC1~ICN are coupled in series by the wires disposed on the array substrate WOA, wherein N is a positive integer larger than or equal to 2.

However, with the increasing size and better display quality of the LCD panel, the number of gate driver chips needed in the LCD panel must become larger and the length of WOA wire needed in the LCD panel must become longer.

As shown in FIG. 2, the driving circuit 2 including a first driver chip IC1 and a second driver chip IC2 is taken as an example, if L output channels corresponding to the first driver chip IC1 are CH11~CH1L and L output channels corresponding to the second driver chip IC2 are CH21~CH2L; R1 is the internal resistance of the first driver chip IC1 which is the total of the resistances of the L output channels CH11~CH1L; R3 is the internal resistance of the second driver chip IC2 which is the total of the resistances of the L output channels CH21~CH2L; R2 is the resistance of the WOA wire coupled between the first driver chip IC1 and the second driver chip IC2. Wherein, L is a positive integer.

It should be noticed that the internal resistance R1 of the first driver chip IC1 will be uniformly distributed among the L output channels CH11~CH1L of the first driver chip IC1 and the internal resistance R2 of the second driver chip IC2 will be uniformly distributed among the L output channels CH21~CH2L of the second driver chip IC2. Thus, the equivalent resistance from the signal source SS to the last output channel (the L-th output channel) CH1L of the first driver chip IC1 is R1 and the equivalent resistance from the signal source SS to the first output channel CH21 of the second driver chip IC2 is (R1+R2). Compared to the internal resistances R1~R2 of the first driver chip IC1 and the second driver chip IC2, the WOA wire has higher resistance and this will cause obvious difference between the output signal intensities of the last output channel (the L-th output channel) CH1L of the first driver chip IC1 and the first output channel CH21 of the second driver chip IC2, and the display quality of the LCD panel will also become poor, even a brighter region will be generated in the center of the dark band of the display frame, such as H-band or H-block phenomenon which should be solved.

SUMMARY OF THE INVENTION

Therefore, the invention provides a driving circuit applied to a LCD apparatus to solve the above-mentioned problems.

A preferred embodiment of the invention is a driving circuit. In this embodiment, the driving circuit is applied to a LCD apparatus. The driving circuit includes N driver chips, a signal source, a first WOA wire and a first COF wire. The N driver chips is packaged in COF packaging way, each of the N driver chips corresponds to and couples to L output channels, wherein N and L are positive integers and N is larger than or equal to 2. The signal source is coupled to a first output channel~a L-th output channel of a first driver chip of the N driver chips, wherein there is a first internal resistance between the first output channel and the L-th output channel of the first driver chip. One terminal of the first WOA wire is coupled to a first output channel~a L-th output channel of a second driver chip of the N driver chips, and there is a second internal resistance between the first output channel and the L-th output channel of the second driver chip. One terminal of the first COF wire is coupled to a first node between the signal source and the first output channel of the first driver chip and another terminal of the first COF wire is coupled to another terminal of the first WOA wire. The first COF wire has a resistance far smaller than the first internal resistance and the first WOA wire has a resistance substantially equal to the first internal resistance.

In an embodiment, the N driver chips are gate driving circuits.

In an embodiment, an equivalent resistance between the first output channel of the second driver chip and the first node is substantially equal to an equivalent resistance between the L-th output channel of the first driver chip and the first node.

In an embodiment, an output signal voltage of the first output channel of the second driver chip is substantially equal to an output signal voltage of the L-th output channel of the first driver chip.

In an embodiment, the first internal resistance and the second internal resistance are variable resistors integrated in the first driver chip and the second driver chip respectively to make an output voltage of the first driver chip substantially equal to an output voltage of the second driver chip.

In an embodiment, the variable resistors are used to compensate signal differences caused by a WOA wire coupled between two driver chips, and the variable resistors have resistances substantially equal to a resistance of the WOA wire coupled between the two driver chips and the resistances of the variable resistors can be adjusted by a gate driving circuit.

In an embodiment, the variable resistors can be formed by metal wires, input/output buffers, CMOS circuits and metal pads, the resistances of the variable resistors can be adjusted through an internal circuit design.

In an embodiment, the variable resistors include a plurality of resistors having different resistances, and the plurality of resistors is coupled to an output buffer of each output channel in parallel and a matching resistance can be selected through COF trace design.

In an embodiment, the variable resistors include a plurality of resistors having different resistances, and the plurality of resistors is coupled to a switch in series and also coupled to an output buffer of each output channel, a logic circuit and a resistance setting input pin in parallel and a matching resistance can be selected through an input logic signal.

In an embodiment, the signal source, the first output channel of the first driver chip and the first output channel of the second driver chip are coupled in series through the first COF wire and the first WOA wire.

In an embodiment, the first internal resistance is a total of resistances of the L output channels of the first driver chip and uniformly distributed among the L output channels of the first driver chip.

In an embodiment, the second internal resistance is a total of resistances of the L output channels of the second driver chip and uniformly distributed among the L output channels of the second driver chip.

In an embodiment, a resistance of the first COF wire is far smaller than a resistance of the first WOA wire and an equivalent resistance between the first output channel of the second driver chip and the signal source is decreased.

In an embodiment, the driving circuit includes a second WOA wire and a second COF wire. One terminal of the second WOA wire is coupled to a first output channel~a L-th output channel of a third driver chip of the N driver chips, and there is a third internal resistance between the first output channel and the L-th output channel of the third driver chip. One terminal of the second COF wire is coupled to a second node between the first WOA wire and the first output channel of the second driver chip and another terminal of the second COF wire is coupled to another terminal of the second WOA wire, wherein the second COF wire has a resistance far smaller than the second internal resistance and the second WOA wire has a resistance substantially equal to the second internal resistance.

In an embodiment, an equivalent resistance between the first output channel of the third driver chip and the second node is substantially equal to an equivalent resistance between the L-th output channel of the second driver chip and the second node.

In an embodiment, an output signal voltage of the first output channel of the third driver chip is substantially equal to an output signal voltage of the L-th output channel of the second driver chip.

In an embodiment, the first internal resistance, the second internal resistance and the third internal resistance are variable resistors integrated in the first driver chip, the second driver chip and the third driver chip respectively to make output voltages of the first driver chip, the second driver chip and the third driver chip substantially equal.

In an embodiment, the variable resistors are used to compensate signal differences caused by a WOA wire coupled between two driver chips, and the variable resistors have resistances substantially equal to a resistance of the WOA wire coupled between the two driver chips and the resistances of the variable resistors can be adjusted by a gate driving circuit.

In an embodiment, the variable resistors can be formed by metal wires, input/output buffers, CMOS circuits and metal pads, the resistances of the variable resistors can be adjusted through an internal circuit design.

In an embodiment, the variable resistors include a plurality of resistors having different resistances, and the plurality of resistors is coupled to an output buffer of each output channel in parallel and a matching resistance can be selected through COF trace design.

In an embodiment, the variable resistors include a plurality of resistors having different resistances, and the plurality of resistors is coupled to a switch in series and also coupled to an output buffer of each output channel, a logic circuit and a resistance setting input pin in parallel and a matching resistance can be selected through an input logic signal.

In an embodiment, the signal source, the first output channel of the first driver chip, the first output channel of the second driver chip and the first output channel of the third driver chip are coupled in series through the first COF wire, the first WOA wire, the second COF wire and the second WOA wire.

In an embodiment, the third internal resistance is a total of resistances of the L output channels of the third driver chip and uniformly distributed among the L output channels of the third driver chip.

In an embodiment, resistances of the first COF wire and the second COF wire are far smaller than resistances of the first WOA wire and the second WOA wire and an equivalent resistance between the first output channel of the third driver chip and the signal source is decreased.

Compared to the prior art, the driving circuit of the LCD apparatus in this invention uses COF wire having lower resistance to replace the coupling of driver chips in series and matches the internal resistance of driver chip with the resistance of WOA wire, so that the difference between the output signal intensities of the last output channel of the previous driver chip and the first output channel of the present driver chip can be largely reduced and the H-band or H-block phenomenon generated in the display frame of LCD panel can be avoided to enhance the display quality of the LCD panel.

The advantage and spirit of the invention may be understood by the following detailed descriptions together with the appended drawings.

BRIEF DESCRIPTION OF THE APPENDED DRAWINGS

FIG. 6A~6D illustrate different circuit structures of the driving circuits applied to the LCD apparatus respectively.

DETAILED DESCRIPTION OF THE INVENTION

A preferred embodiment of the invention is a driving circuit applied to a LCD apparatus. In this embodiment, the driving circuit can be a gate driving circuit applied to LCD apparatus and includes a plurality of gate driver chips, but not limited to this.

At first, a driving circuit including two driver chips applied to the LCD apparatus in the invention is taken as an example.

Figure 1:
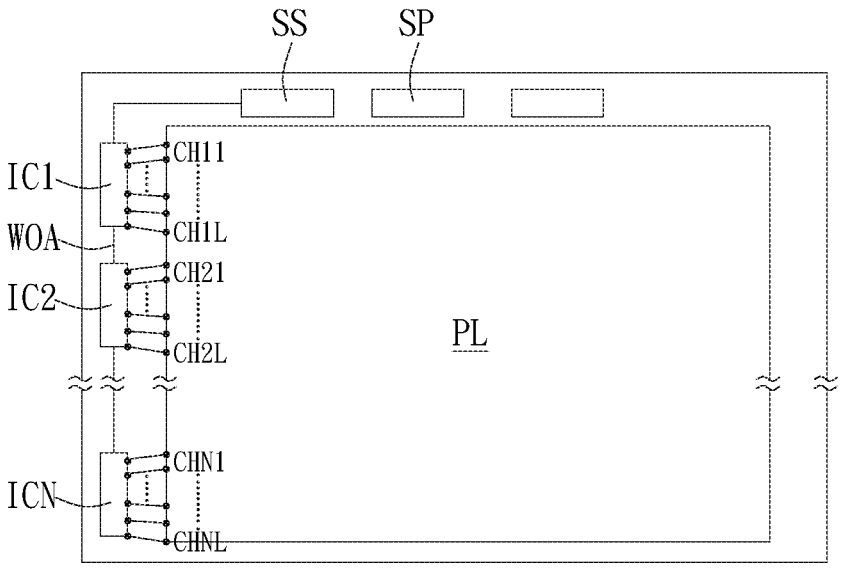
FIG. 1 (PRIOR ART)
FIG. 1 illustrates a schematic diagram of the liquid crystal display system in the prior art.
Figure 2:
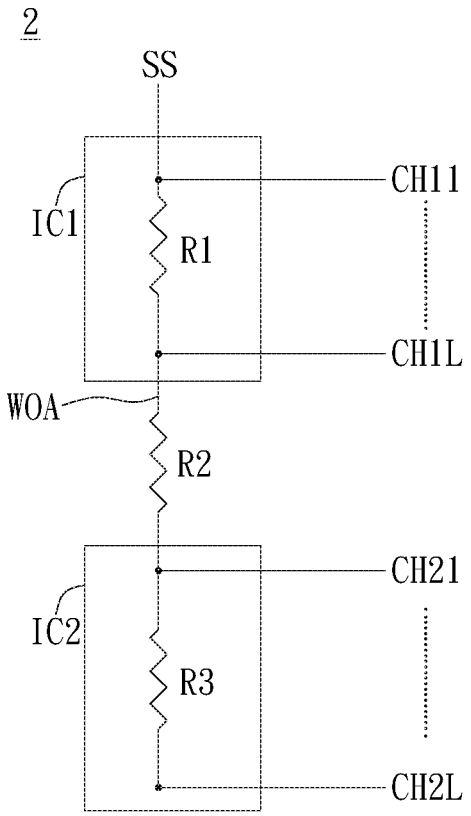
FIG. 2 (PRIOR ART)
FIG. 2 illustrates a schematic diagram of the first driver chip and the second driver chip coupled by the WOA wire in series in the driving circuit in the prior art.
Figure 3:
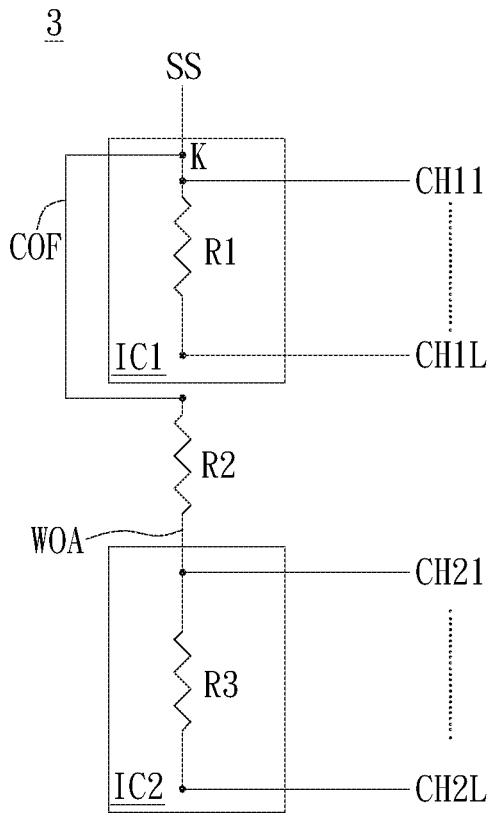
FIG. 3 illustrates a schematic diagram of the driving circuit applied to the LCD display including the first driver chip and the second driver chip in a preferred embodiment of the invention.

Please refer to FIG. 3. FIG. 3 illustrates a schematic diagram of the driving circuit 3 applied to the LCD display including the first driver chip IC1 and the second driver chip IC2 in a preferred embodiment of the invention.

As shown in FIG. 3, the driving circuit 3 includes a signal source SS, a first driver chip IC1, a second driver chip IC2, a wire-on-array wire WOA and a chip-on-film wire COF. Wherein, the first driver chip IC1 and the second driver chip IC2 are both packaged by the COF packaging method. The first driver chip IC1 corresponds and coupled to L output channels CH11~CH1L and the second driver chip IC2 corresponds and coupled to L output channels CH21~CH2L, wherein L is a positive integer.

The signal source SS is coupled to the first output channel CH11~the L-th output channel CH1L of the first driver chip IC1, and there is a first internal resistance R1 among the first output channel CH11~the L-th output channel CH1L of the first driver chip IC1. It should be noticed that the first internal resistance R1 is the total of the resistances of the L output channels CH11~CH1L of the first driver chip IC1 and uniformly distributed among the L output channels CH11~CH1L of the first driver chip IC1.

The first terminal of the COF wire COF is coupled to a first node K between the signal source SS and the first output channel CH11 of the first driver chip IC1 and the second terminal of the COF wire COF is coupled to the first terminal of the WOA wire WOA. The second terminal of the COF wire COF is coupled to the first output channel CH21~the L-th output channel CH2L of the second driver chip IC2, and there is a second internal resistance R3 among the first output channel CH21~the L-th output channel CH2L of the second driver chip IC2.

It should be noticed that the second internal resistance R3 is the total of the resistances of the L output channels CH21~CH2L of the second driver chip IC2 and uniformly distributed among the L output channels CH21~CH2L of the second driver chip IC2. In addition, the resistance of the COF wire COF is far smaller than the first internal resistance R1 and the resistance R2 of the WOA wire WOA is substantially equal to the first internal resistance R1. That is to say, compared to the first internal resistance R1 of the first driver chip IC1 and the second internal resistance R3 of the second driver chip IC2, the resistance of the COF wire COF is very small and even can be neglected. Thus, the equivalent resistance between the first output channel CH21 of the second driver chip IC2 and the signal source SS can be reduced.

It should be noticed that the resistance R2 of the WOA wire WOA is substantially equal to the first internal resistance R1 and the resistance of the COF wire COF is far smaller than the resistance R2 of the WOA wire WOA; therefore, if the resistance of the COF wire COF is neglected, then the equivalent resistance R2 between the first output channel CH21 of the second driver chip IC2 and the first node K will be substantially equal to the equivalent resistance R1 between the L-th output channel CH1L of the first driver chip IC1 and the first node K. At this time, the output signal voltage of the first output channel CH21 of the second driver chip IC2 will be also substantially equal to the output signal voltage of the L-th output channel CH1L of the first driver chip IC1.

In practical applications, the first internal resistance R1 of the first driver chip IC1 and the second internal resistance R3 of the second driver chip IC2 can be variable resistors integrated in the first driver chip IC1 and the second driver chip IC2 respectively to compensate the signal differences caused by the WOA wire WOA coupled between the first driver chip IC1 and the second driver chip IC2, and the resistances of the variable resistors can be adjusted by a gate driving circuit, so that their resistances can be substantially equal to the resistance of the WOA wire WOA and the output voltage of the first driver chip IC1 can be substantially equal to the output voltage of the second driver chip IC2. In fact, the variable resistors can be formed by metal wires, input/output buffers, CMOS circuits and metal pads, but not limited to this.

Figure 4A:
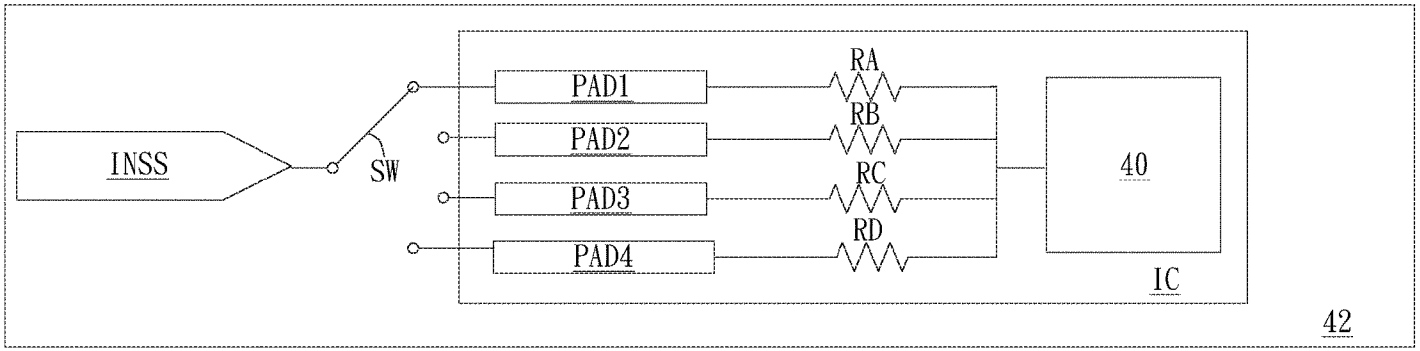
FIG. 4A and FIG. 4B illustrate different embodiments of adjusting the resistance of variable resistor through the gate driving circuit respectively.
Figure 4B:
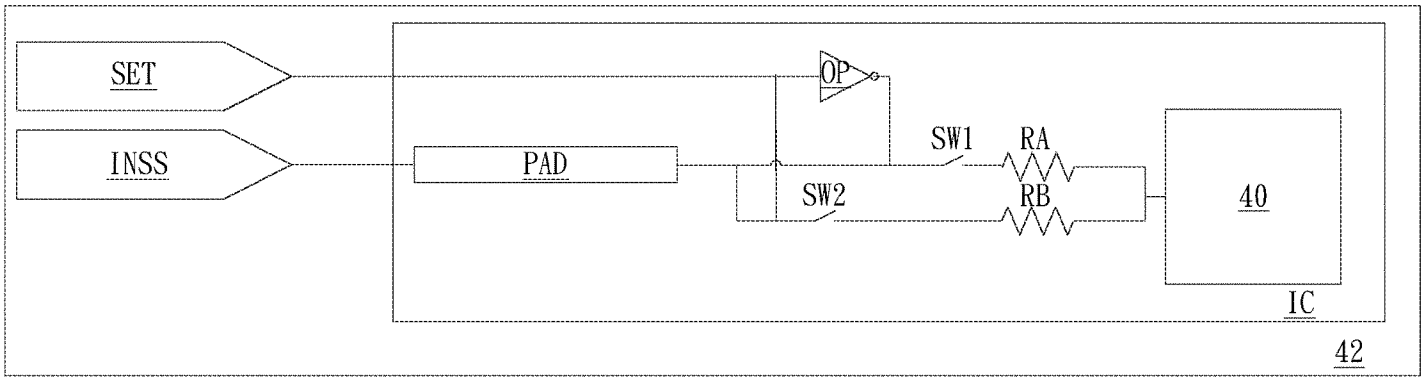

Please refer to FIG. 4A and FIG. 4B. FIG. 4A and FIG. 4B illustrate different embodiments of adjusting the resistance of variable resistor through the gate driving circuit respectively.

As shown in FIG. 4A, the gate driving circuit IC is packaged by COF packaging method to form a COF packaging object 42. In fact, the variable resistor can include a plurality of resistors RA~RD having different resistances. The plurality of resistors RA~RD is coupled in parallel and one terminal of the plurality of resistors RA~RD is coupled to different input pads PAD1~PAD4 respectively; another terminal of the plurality of resistors RA~RD is coupled to the logic circuit 40. It should be noticed that the signal source input terminal INSS can be selectively coupled to corresponding input pads PAD1~PAD4 according to different COF trace design ways to select a resistor RA, RB, RC or RD having suitable matching resistance.

It should be noticed that the number of the plurality of resistors can be adjusted based on practical needs and not limited by four resistors of this embodiment; in addition, the above-mentioned plurality of resistors can have different resistances based on practical needs without specific limitations.

As shown in FIG. 4B, the gate driving circuit IC is packaged by COF packaging method to form the COF packaging object 42. In fact, the variable resistor can include a plurality of resistors RA~RB having different resistances. The plurality of resistors RA~RB is coupled in parallel and one terminal of the plurality of resistors RA~RB is coupled to switches SW1~SW2 respectively and another terminal of the plurality of resistors RA~RB is coupled to the logic circuit 40. The switches SW1~SW2 are coupled to the same input pad PAD. The resistance setting input pin SET is coupled between the input pad PAD and the switch SW2; the resistance setting input pin SET is coupled to the amplifier OP and the amplifier OP is coupled between the input pad PAD and the switch SW1. An input logic signal can control the operation of the switches SW1~SW2 through the resistance setting input pin SET, so that the signal source input terminal INSS can select the resistor RA or RB having suitable matching resistance through the input pad PAD.

It should be noticed that the number of the plurality of resistors can be adjusted based on practical needs and not limited by four resistors of this embodiment; in addition, the above-mentioned plurality of resistors can have different resistances based on practical needs without specific limitations.

Next, the driving circuit including three driver chips in the LCD apparatus of the invention is taken as an example.

Figure 5A:
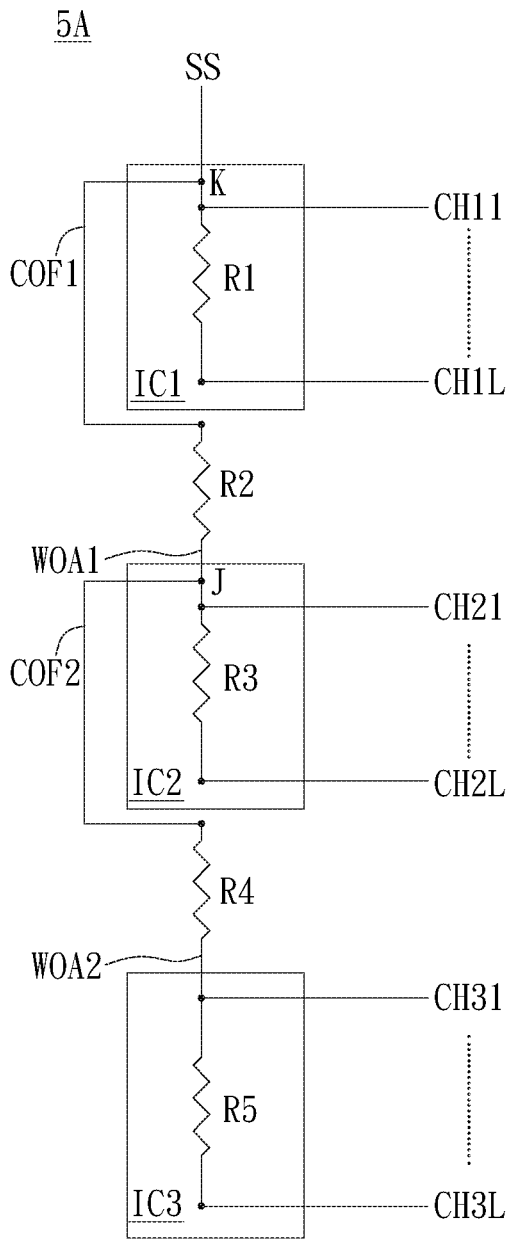
FIG. 5A illustrates a schematic diagram of the driving circuit applied to the LCD display including the first driver chip, the second driver chip and the third driver chip in another preferred embodiment of the invention.

Please refer to FIG. 5A. FIG. 5A illustrates a schematic diagram of the driving circuit 5A applied to the LCD display including the first driver chip IC1, the second driver chip IC2 and the third driver chip IC3 in another preferred embodiment of the invention.

As shown in FIG. 5A, the driving circuit 5A includes a signal source SS, a first driver chip IC1, a second driver chip IC2, a third driver chip IC3, a first WOA wire WOA1, a second WOA wire WOA2, a first COF wire COF1 and a second COF wire COF2. Wherein, the first driver chip IC1~the third driver chip IC3 are packaged by the COF packaging method. The first driver chip IC1 corresponds and couples to L output channels CH11~CH1L; the second driver chip IC2 corresponds and couples to L output channels CH21~CH2L; the third driver chip IC3 corresponds and couples to L output channels CH31~CH3L, wherein L is a positive integer. The signal source SS is coupled to the first output channel CH11~the L-th output channel CH1L of the first driver chip IC1 and there is a first internal resistance R1 among the first output channel CH11~the L-th output channel CH1L of the first driver chip IC1.

In this embodiment, the first terminal of the first COF wire COF1 is coupled to a first node K between the signal source SS and the first output channel CH11 of the first driver chip IC1; the second terminal of the first COF wire COF1 is coupled to the first terminal of the first WOA wire WOA1. The second terminal of the first WOA wire WOA1 is coupled to the first output channel CH21~the L-th output channel CH2L of the second driver chip IC2 and there is a second internal resistance R3 among the first output channel CH21~the L-th output channel CH2L of the second driver chip IC2. Wherein, the resistance of the first COF wire COF1 is far smaller than the first internal resistance R1; the resistance R2 of the first WOA wire WOA1 is substantially equal to the first internal resistance R1. That is to say, compared to the first internal resistance R1 of the first driver chip IC1 and the second internal resistance R3 of the second driver chip IC2, the resistance of the first COF wire COF1 is very small and even can be neglected.

Similarly, the first terminal of the second COF wire COF2 is coupled to a second node J between the first WOA wire WOA1 and the first output channel CH21 of the second driver chip IC2; the second terminal of the second COF wire COF2 is coupled to the first terminal of the second WOA wire WOA2. The second terminal of the second WOA wire WOA2 is coupled to the first output channel CH31~the L-th output channel CH3L of the third driver chip IC3 and there is a third internal resistance R5 among the first output channel CH31~the L-th output channel CH3L of the third driver chip IC3. The third internal resistance R5 is the total of the resistances of the L output channels CH31~CH3L of the third driver chip IC3 and uniformly distributed among the L output channels CH31~CH3L of the third driver chip IC3.

Wherein, the resistance of the second COF wire COF2 is far smaller than the second internal resistance R3; the resistance R4 of the second WOA wire WOA2 is substantially equal to the second internal resistance R3. That is to say, compared to the second internal resistance R3 of the second driver chip IC2 and the third internal resistance R5 of the third driver chip IC3, the resistance of the second COF wire COF2 is very small and even can be neglected. Since the resistances of the first COF wire COF1 and the second COF wire COF2 is far smaller than the resistances of the first WOA wire WOA1 and the second WOA wire WOA2, the equivalent resistance between the first output channel CH31 of the third driver chip IC3 and the signal source SS will be reduced.

It should be noticed that the resistance R4 of the second WOA wire WOA2 is substantially equal to the second internal resistance R3, and the resistance of the second COF wire COF2 is far smaller than the resistance R4 of the second WOA wire WOA2; therefore, if the resistance of the second COF wire COF2 is neglected, the equivalent resistance R4 between the first output channel CH31 of the third driver chip IC3 and the second node J will be substantially equal to the equivalent resistance R3 between the L-th output channel CH2L of the second driver chip IC2 and the second node J. At this time, the output signal voltage of the first output channel CH31 of the third driver chip IC3 will be substantially equal to the output signal voltage of the L-th output channel CH2L of the second driver chip IC2.

In practical applications, the first internal resistance R1 of the first driver chip IC1, the second internal resistance R3 of the second driver chip IC2 and the third internal resistance R5 of the third driver chip IC3 can be variable resistors integrated in the first driver chip IC1, the second driver chip IC2 and the third driver chip IC3 respectively to compensate the signal differences caused by the first WOA wire WOA1 coupled between the first driver chip IC1 and the second driver chip IC2 and the second WOA wire WOA2 coupled between the second driver chip IC2 and the third driver chip IC3, and the resistances of the variable resistors can be adjusted by a gate driving circuit, so that their resistances can be substantially equal to the resistances of the first WOA wire WOA1 and the second WOA wire WOA2; the output voltage of the first driver chip IC1 can be substantially equal to the output voltage of the second driver chip IC2 and the output voltage of the third driver chip IC3. In fact, the variable resistors can be formed by metal wires, input/output buffers, CMOS circuits and metal pads, but not limited to this.

It should be noticed that driving circuits including two or three driver chips are taken as examples of the invention; in fact, the driving circuits including more driver chips can be also examples of the invention, and the number of output channels corresponded and coupled to each driver chip can be also adjusted based on different sizes of display panel without specific limitations.

Therefore, the driving circuit including N driver chips is taken as an example, wherein N is a positive integer.

Figure 5B:
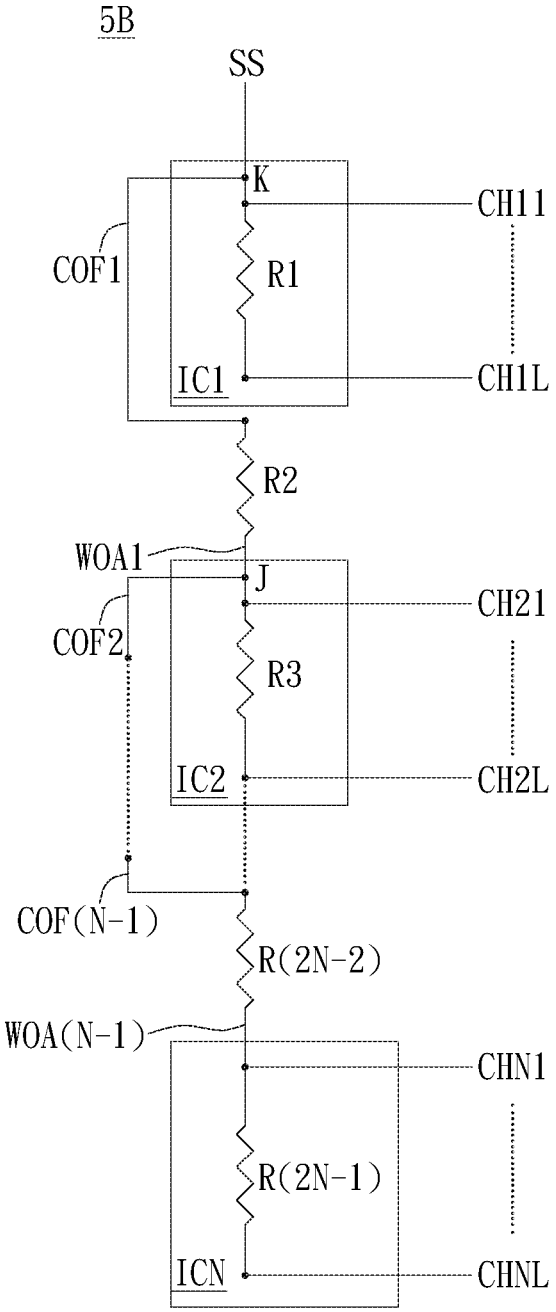
FIG. 5B illustrates a schematic diagram of the driving circuit 5B applied to the LCD display including the first driver chip IC1, the second driver chip IC2, . . . and a N-th driver chip ICN in another preferred embodiment of the invention.

Please refer to FIG. 5B. FIG. 5B illustrates a schematic diagram of the driving circuit 5B applied to the LCD display including the first driver chip IC1, the second driver chip IC2, . . . and a N-th driver chip ICN in another preferred embodiment of the invention.

As shown in FIG. 5B, the driving circuit 5B includes a signal source SS, a first driver chip IC1~a N-th driver chip ICN, a first WOA wire WOA1~a (N−1)-th WOA wire WOA(N−1) and a first COF wire COF1~a (N−1)-th COF wire COF(N−1). Wherein, the first driver chip IC1~the N-th driver chip ICN are packaged through the COF packaging method.

The first driver chip IC1 corresponds and couples to L output channels CH11~CH1L; the second driver chip IC2 corresponds and couples to L output channels CH21~CH2L; . . . ; similarly, the N-th driver chip ICN corresponds and couples to L output channels CHN1~CHNL, wherein L is a positive integer.

There is a first internal resistance R1 among the first output channel CH11 the L-th output channel CH1L of the first driver chip IC1, and the first internal resistance R1 is the total of the resistances of the L output channels CH11~CH1L of the first driver chip IC1 and uniformly distributed among the L output channels CH11~CH1L of the first driver chip IC1. Similarly, there is a second internal resistance R3 among the first output channel CH21~the L-th output channel CH2L of the second driver chip IC2, and the second internal resistance R3 is the total of the resistances of the L output channels CH21~CH2L of the second driver chip IC2 and uniformly distributed among the L output channels CH21~CH2L of the second driver chip IC2. There is a N-th internal resistance R(2N−1) among the first output channel CHN1~the L-th output channel CHNL of the N-th driver chip ICN, and the N-th internal resistance R(2N−1) is the total of the resistances of the L output channels CHN1~CHNL of the N-th driver chip ICN and uniformly distributed among the L output channels CHN1~CHNL of the N-th driver chip ICN.

It should be noticed that the internal resistances R1, R3, . . . , R(2N−1) of the N driver chips IC1~ICN in the driving circuit 5B of the invention can be designed as variable resistors and their resistances can be adjusted through the internal circuit designing method. Thus, the driving circuit 5B of the invention can compensate the signal differences caused by the WOA wires coupled between the two driver chips through the variable internal resistances R1, R3, . . . , R(2N−1) of the N driver chips IC1~ICN.

The signal source SS is coupled to the first output channel CH11~the L-th output channel CH1L of the first driver chip IC1. The first terminal of the first COF wire COF1 is coupled to a first node K between the signal source SS and the first output channel CH11 of the first driver chip IC1; the second terminal of the first COF wire COF1 is coupled to the first terminal of the first WOA wire WOA1. The second terminal of the first WOA wire WOA1 is coupled to the first output channel CH21~the L-th output channel CH2L of the second driver chip IC2. The first terminal of the second COF wire COF2 is coupled to a second node J between the first WOA wire WOA1 and the first output channel CH21 of the second driver chip IC2; the second terminal of the second COF wire COF2 is coupled to the first terminal of the second WOA wire WOA2 (not shown in the figures).

It should be noticed that the resistance of the first COF wire COF1 is far smaller than the first internal resistance R1 of the first driver chip IC1. That is to say, compared to the first internal resistance R1 of the first driver chip IC1 and the second internal resistance R3 of the second driver chip IC2, the resistance of the first COF wire COF1 is very small and even can be neglected. Therefore, if the resistance of the first COF wire COF1 is neglected, the equivalent resistance between the first output channel CH21 of the second driver chip IC2 and the signal source SS will be substantially equal to the resistance R2 of the first WOA wire WOA1 and obviously smaller than the equivalent resistance between the first output channel CH21 of the second driver chip IC2 and the signal source SS in the prior art.

In addition, since the resistance R2 of the first WOA wire WOA1 is substantially equal to the first internal resistance R1 of the first driver chip IC1, the equivalent resistance between the first output channel CH21 of the second driver chip IC2 and the signal source SS will be substantially equal to the equivalent resistance between the L-th output channel CH1L of the first driver chip IC1 and the signal source SS. Therefore, the output signal voltage of the first output channel CH21 of the second driver chip IC2 will be also substantially equal to the output signal voltage of the L-th output channel CH1L of the first driver chip IC1.

Similarly, the resistance of the second COF wire COF2 is far smaller than the second internal resistance R2 of the second driver chip IC2 and even can be neglected; . . . ; the resistance of the (N−1)-th COF wire COF(N−1) is far smaller than the (N−1)-th internal resistance R(N−1) of the (N−1)-th driver chip IC(N−1) and even can be neglected. If the resistances of the first COF wire COF1~the (N−1)-th COF wire COF(N−1) are neglected, the equivalent resistance between the first output channel CHN1 of the N-th driver chip ICN and the signal source SS will be substantially equal to the total of the resistance R2 of the first WOA wire WOA1~the resistance R(2N−2) of the (N−1)-th WOA wire WOA(N−1) and obviously smaller than the equivalent resistance between the first output channel CHN1 of the N-th driver chip ICN and the signal source SS in the prior art.

In addition, since the resistance R(2N−2) of the (N−1)-th WOA wire WOA(N−1) is substantially equal to the (N−1)-th internal resistance R(N−1) of the (N−1)-th driver chip IC(N−1), the equivalent resistance between the first output channel CHN1 of the N-th driver chip ICN and the signal source SS will be substantially equal to the equivalent resistance between the L-th output channel CH(N−1)L of the (N−1)-th driver chip IC(N−1) and the signal source SS; therefore, the output signal voltage of the first output channel CHN1 of the N-th driver chip ICN will be substantially equal to the output signal voltage of the first output channel CHN1 of the N-th driver chip ICN.

Above all, it can be found that the voltage difference between the last output channel of a first driver chip and the first output channel of a second driver chip next to the first driver chip in the driving circuit of the invention will approach 0. That is to say, the driving circuit of the invention can obviously reduce the voltage difference between the last output channel of the first driver chip and the first output channel of the second driver chip next to the first driver chip in the conventional driving circuit. Therefore, the driving circuit of the invention can effectively avoid the H-band or H-block in the display frame of the liquid crystal display panel caused by this output voltage difference to largely enhance the display quality of the liquid crystal display panel.

Figure 6A:
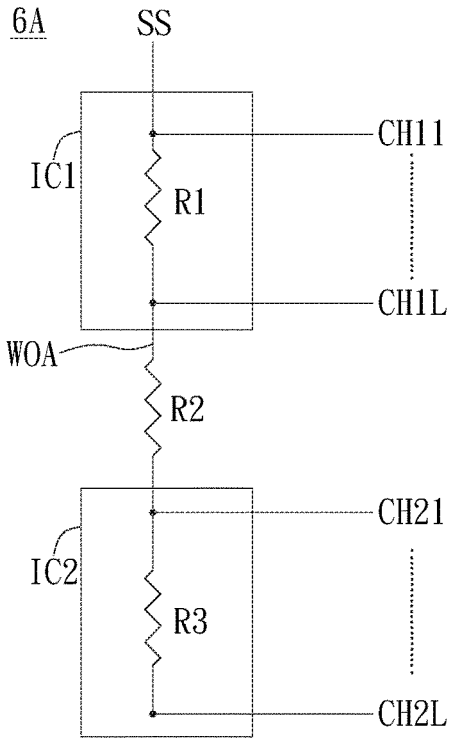
Figure 6B:
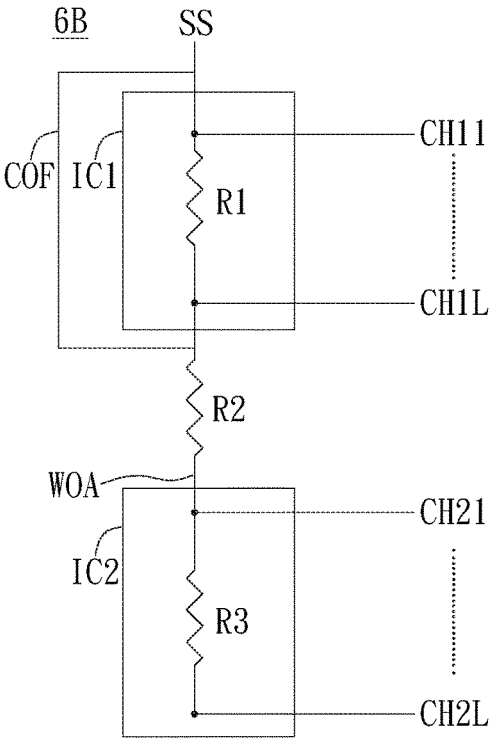
Figure 6C:
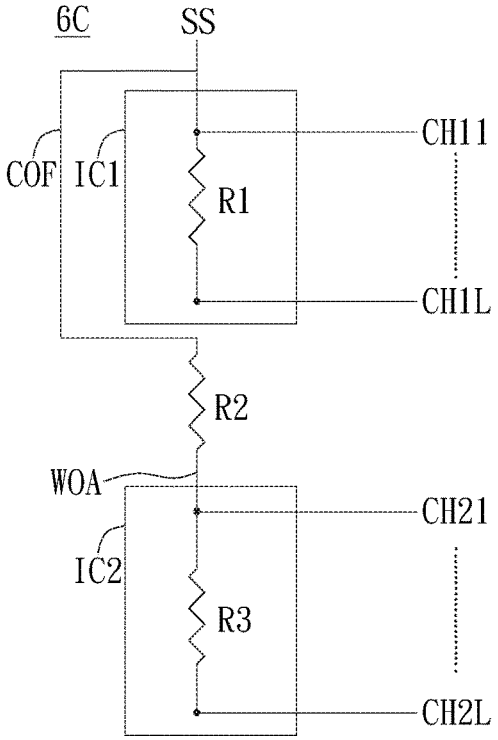

Please refer FIG. 6A~FIG. 6D. FIG. 6A~6D illustrate different circuit structures of the driving circuits applied to the LCD apparatus respectively. It should be noticed that the driving circuit applied to LCD apparatus of the invention is realized by the driving circuit 6D of FIG. 6D; the driving circuits 6A~6C of FIG. 6A~FIG. 6C are control groups of the simulation experiments.

As shown in FIG. 6A, the driving circuit 6A applied to the LCD apparatus includes a first driver chip IC1 and a second driver chip IC2. The first driver chip IC1 is coupled to the signal source SS. There is a first internal resistance R1 among the first output channel CH11~the L-th output channel CH1L of the first driver chip IC1; there is a second internal resistance R3 among the first output channel CH21~the L-th output channel CH2L of the second driver chip IC2. The L-th output channel CH1L of the first driver chip IC1 and the first output channel CH21 of the second driver chip IC2 will be electrically connected by the WOA wire WOA having a resistance R2. In this embodiment, the output voltages of the output channels are simulated according to conditions of L=784, R1=R3=6Ω, R2=44Ω.

As shown in FIG. 6B, the difference between the driving circuit 6B and the driving circuit 6A applied to the LCD apparatus is that the driving circuit 6B further includes the COF wire COF and the resistance of the COF wire COF is far smaller than the resistance of the WOA wire WOA. One terminal of the COF wire COF is electrically connected between the signal source SS and the first output channel CH11 of the first driver chip IC1; the other terminal of the COF wire COF is electrically connected between the L-th output channel CH1L of the first driver chip IC1 and the WOA wire WOA. In other words, two terminals of the first driving chip IC1 are electrically connected to the COF wire COF. In this embodiment, the output voltages of the output channels are simulated according to conditions of L=784, R1=R3=6Ω, R2=44Ω.

As shown in FIG. 6C, the difference between the driving circuit 6C and the driving circuit 6B applied to the LCD apparatus is that the L-th output channel CH1L of the first driver chip IC1 and the WOA wire WOA are not electrically connected in the driving circuit 6C; that is to say, the signal source SS and the second driver chip IC2 are electrically connected through the COF wire COF and the WOA wire WOA in order. In other words, only one terminal of the first driver chip IC1 is electrically connected to the COF wire COF. In this embodiment, the output voltages of the output channels are simulated according to conditions of L=784, R1=R3=6Ω, R2=44Ω.

Figure 6D:
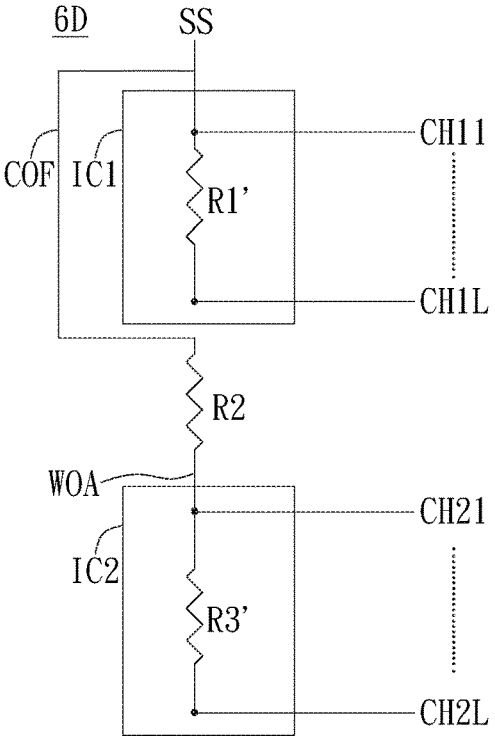

As shown in FIG. 6D, the difference between the driving circuit 6D and the driving circuit 6C applied to the LCD apparatus is that the first internal resistance R1' of the first driver chip IC1 and the second internal resistance R3' of the second driver chip IC2 in the driving circuit 6D is substantially equal to the resistance R2 of the WOA wire WOA while the first internal resistance R1 of the driving circuits 6A~6C is smaller than the resistance R2 of the WOA wire WOA. Therefore, in this embodiment, the output voltages of the output channels are simulated according to conditions of L=784, R1=R2=R3=44Ω.

TABLE 1

| | Driver circuit 6A | Driver circuit 6B | Driver circuit 6C | Driver circuit 6D |
|---|---|---|---|---|
| Is COF wire disposed? | NO | YES | YES | YES |
| Number of terminals of first driver chip IC1 electrically connected to COF wire | NO | 2 | 1 | 1 |
| First internal resistance R1 and second internal resistance R3 (Ω) | 6 | 6 | 6 | 44 |
| Output voltage of output channel CH1L (V) | 18.6 | 18.7 | 18.6 | 18.2 |
| Output voltage of output channel CH21 (V) | 18.2 | 18.2 | 18.2 | 18.2 |
| Difference between output voltages of output channels CH1L and CH21 (V) | 0.4 | 0.5 | 0.4 | 0 |

Please refer to Table 1. Table 1 shows the circuit simulation results of the driving circuits 6A~6D of FIG. 6A~FIG. 6D. According to the simulation results of the driving circuits 6A~6D of FIG. 6A~FIG. 6D, it can be found that the output voltage of the last output channel CH1L of the first driver chip IC1 of the driving circuit 6D is obviously lower than the output voltage of the last output channel CH1L of the first driver chip IC1 of the driving circuits 6A-6C, and the output voltage of the last output channel CH1L of the first driver chip IC1 of the driving circuit 6D approaches the output voltage of the first output channel CH21 of the second driver chip IC2. By doing so, the voltage difference between the last output channel CH1L of the first driver chip IC1 and the first output channel CH21 of the second driver chip IC2 in the driving circuit 6D will approach zero; that is to say, the driving circuit 6D obviously reduces the voltage difference between the last output channel CH1L of the first driver chip IC1 and the first output channel CH21 of the second driver chip IC2 in the driving circuits 6A-6C. Therefore, the driving circuit of the invention can obviously reduce. Therefore, the driving circuit of the invention can effectively avoid the H-band or H-block in the display frame of the liquid crystal display panel caused by this voltage difference between the last output channel of the first driver chip and the first output channel of the second driver chip next to the first driver chip in the conventional driving circuit, and the display quality of the liquid crystal display panel can be largely enhanced.

Compared to the prior art, the driving circuit of the LCD apparatus in this invention uses COF wire having lower resistance to replace the coupling of driver chips in series and matches the internal resistance of driver chip with the resistance of WOA wire, so that the difference between the output signal intensities of the last output channel of the previous driver chip and the first output channel of the present driver chip can be largely reduced and the H-band or H-block phenomenon generated in the display frame of LCD panel can be avoided to enhance the display quality of the LCD panel.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. A driving circuit applied to a LCD apparatus, the driving circuit comprising:

N driver chips packaged in COF packaging way, each of the N driver chips corresponding to and coupling to L output channels, wherein N and L are positive integers and N is larger than or equal to 2; and a signal source coupled to a first output channel~a L-th output channel of a first driver chip of the N driver chips, wherein there is a first internal resistance between the first output channel and the L-th output channel of the first driver chip;

a first WOA wire, wherein one terminal of the first WOA wire is coupled to a first output channel~a L-th output channel of a second driver chip of the N driver chips, and there is a second internal resistance between the first output channel and the L-th output channel of the second driver chip; and a first COF wire, wherein one terminal of the first COF wire is coupled to a first node between the signal source and the first output channel of the first driver chip and another terminal of the first COF wire is coupled to another terminal of the first WOA wire;

wherein the first COF wire has a resistance far smaller than the first internal resistance and the first WOA wire has a resistance substantially equal to the first internal resistance; the first internal resistance and the second internal resistance are variable resistors integrated in the first driver chip and the second driver chip respectively to make an output voltage of the first driver chip substantially equal to an output voltage of the second driver chip; the variable resistors are used to compensate signal differences caused by a WOA wire coupled between two driver chips, and the variable resistors have resistances substantially equal to a resistance of the WOA wire coupled between the two driver chips and the resistances of the variable resistors can be adjusted by a gate driving circuit the variable resistors comprise a plurality of resistors having different resistances, and the plurality of resistors is coupled to an output buffer of each output channel in parallel and a matching resistance can be selected through COF trace design.

2. The driving circuit of claim 1, wherein the N driver chips are gate driving circuits.

3. The driving circuit of claim 1, wherein an equivalent resistance between the first output channel of the second driver chip and the first node is substantially equal to an equivalent resistance between the L-th output channel of the first driver chip and the first node.

4. The driving circuit of claim 1, wherein an output signal voltage of the first output channel of the second driver chip is substantially equal to an output signal voltage of the L-th output channel of the first driver chip.

5. The driving circuit of claim 1, wherein the variable resistors can be formed by metal wires, input/output buffers, CMOS circuits and metal pads, the resistances of the variable resistors can be adjusted through an internal circuit design.

6. A driving circuit applied to a LCD apparatus, the driving circuit comprising:

N driver chips packaged in COF packaging way, each of the N driver chips corresponding to and coupling to L output channels, wherein N and L are positive integers and N is larger than or equal to 2;

a signal source coupled to a first output channel~a L-th output channel of a first driver chip of the N driver chips, wherein there is a first internal resistance between the first output channel and the L-th output channel of the first driver chip;

a first WOA wire, wherein one terminal of the first WOA wire is coupled to a first output channel~a L-th output channel of a second driver chip of the N driver chips, and there is a second internal resistance between the first output channel and the L-th output channel of the second driver chip; and a first COF wire, wherein one terminal of the first COF wire is coupled to a first node between the signal source and the first output channel of the first driver chip and another terminal of the first COF wire is coupled to another terminal of the first WOA wire;

wherein the first COF wire has a resistance far smaller than the first internal resistance and the first WOA wire has a resistance substantially equal to the first internal resistance; the first internal resistance and the second internal resistance are variable resistors integrated in the first driver chip and the second driver chip respectively to make an output voltage of the first driver chip substantially equal to an output voltage of the second driver chip; the variable resistors are used to compensate signal differences caused by a WOA wire coupled between two driver chips, and the variable resistors have resistances substantially equal to a resistance of the WOA wire coupled between the two driver chips and the resistances of the variable resistors can be adjusted by a gate driving circuit the variable resistors comprise a plurality of resistors having different resistances, and the plurality of resistors is coupled to a switch in series and also coupled to an output buffer of each output channel, a logic circuit and a resistance setting input pin in parallel and a matching resistance can be selected through an input logic signal.

7. The driving circuit of claim 1, wherein the signal source, the first output channel of the first driver chip and the first output channel of the second driver chip are coupled in series through the first COF wire and the first WOA wire.

8. The driving circuit of claim 1, wherein the first internal resistance is a total of resistances of the L output channels of the first driver chip and uniformly distributed among the L output channels of the first driver chip.

9. The driving circuit of claim 1, wherein the second internal resistance is a total of resistances of the L output channels of the second driver chip and uniformly distributed among the L output channels of the second driver chip.

10. The driving circuit of claim 1, wherein a resistance of the first COF wire is far smaller than a resistance of the first WOA wire and an equivalent resistance between the first output channel of the second driver chip and the signal source is decreased.

11. A driving circuit applied to a LCD apparatus, the driving circuit comprising:

N driver chips packaged in COF packaging way, each of the N driver chips corresponding to and coupling to L output channels, wherein N and L are positive integers and N is larger than or equal to 2;

a signal source coupled to a first output channel~a L-th output channel of a first driver chip of the N driver chips, wherein there is a first internal resistance between the first output channel and the L-th output channel of the first driver chip;

a first WOA wire, wherein one terminal of the first WOA wire is coupled to a first output channel~a L-th output channel of a second driver chip of the N driver chips, and there is a second internal resistance between the first output channel and the L-th output channel of the second driver chip;

a first COF wire, wherein one terminal of the first COF wire is coupled to a first node between the signal source and the first output channel of the first driver chip and another terminal of the first COF wire is coupled to another terminal of the first WOA wire;

a second WOA wire, wherein one terminal of the second WOA wire is coupled to a first output channel~a L-th output channel of a third driver chip of the N driver chips, and there is a third internal resistance between the first output channel and the L-th output channel of the third driver chip; and a second COF wire, wherein one terminal of the second COF wire is coupled to a second node between the first WOA wire and the first output channel of the second driver chip and another terminal of the second COF wire is coupled to another terminal of the second WOA wire;

wherein the first COF wire has a resistance far smaller than the first internal resistance and the first WOA wire has a resistance substantially equal to the first internal resistance; the second COF wire has a resistance far smaller than the second internal resistance and the second WOA wire has a resistance substantially equal to the second internal resistance; the third internal resistance is a total of resistances of the L output channels of the third driver chip and uniformly distributed among the L output channels of the third driver chip.

12. The driving circuit of claim 11, wherein an equivalent resistance between the first output channel of the third driver chip and the second node is substantially equal to an equivalent resistance between the L-th output channel of the second driver chip and the second node.

13. The driving circuit of claim 11, wherein an output signal voltage of the first output channel of the third driver chip is substantially equal to an output signal voltage of the L-th output channel of the second driver chip.

14. The driving circuit of claim 11, wherein the first internal resistance, the second internal resistance and the third internal resistance are variable resistors integrated in the first driver chip, the second driver chip and the third driver chip respectively to make output voltages of the first driver chip, the second driver chip and the third driver chip substantially equal.

15. The driving circuit of claim 14, wherein the variable resistors are used to compensate signal differences caused by a WOA wire coupled between two driver chips, and the variable resistors have resistances substantially equal to a resistance of the WOA wire coupled between the two driver chips and the resistances of the variable resistors can be adjusted by a gate driving circuit.

16. The driving circuit of claim 15, wherein the variable resistors can be formed by metal wires, input/output buffers, CMOS circuits and metal pads, the resistances of the variable resistors can be adjusted through an internal circuit design.

17. The driving circuit of claim 15, wherein the variable resistors comprise a plurality of resistors having different resistances, and the plurality of resistors is coupled to an output buffer of each output channel in parallel and a matching resistance can be selected through COF trace design.

18. The driving circuit of claim 15, wherein the variable resistors comprise a plurality of resistors having different resistances, and the plurality of resistors is coupled to a switch in series and also coupled to an output buffer of each output channel, a logic circuit and a resistance setting input pin in parallel and a matching resistance can be selected through an input logic signal.

19. The driving circuit of claim 11, wherein the signal source, the first output channel of the first driver chip, the first output channel of the second driver chip and the first output channel of the third driver chip are coupled in series through the first COF wire, the first WOA wire, the second COF wire and the second WOA wire.

20. The driving circuit of claim 11, wherein resistances of the first COF wire and the second COF wire are far smaller than resistances of the first WOA wire and the second WOA wire and an equivalent resistance between the first output channel of the third driver chip and the signal source is decreased.

* * * * *